US010293232B2

(12) United States Patent
Brangers et al.

(10) Patent No.: US 10,293,232 B2
(45) Date of Patent: May 21, 2019

(54) BASKETBALL LIGHT RAISING AND LOWERING APPARATUS AND METHOD

(71) Applicant: Indian Industries, Inc., Evansville, IN (US)

(72) Inventors: Todd Brangers, Evansville, IN (US); Philip Elpers, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 70 days.

(21) Appl. No.: 15/414,695

(22) Filed: Jan. 25, 2017

(65) Prior Publication Data

US 2018/0207501 A1 Jul. 26, 2018

(51) Int. Cl.
*F21V 33/00* (2006.01)
*A63B 63/08* (2006.01)

(52) U.S. Cl.
CPC ..... *A63B 63/083* (2013.01); *F21V 33/008* (2013.01); *A63B 2207/02* (2013.01); *A63B 2225/09* (2013.01)

(58) Field of Classification Search
CPC ..... A63B 63/083; A63B 2207/00; A63B 2207/02; G09F 2011/0027; G09F 13/00; G09F 13/18; G09F 13/222; G09F 13/30; G09F 13/46; G09F 13/22; G09F 13/20; G09F 13/04; G09F 2013/0418
USPC ..... 362/253
See application file for complete search history.

(56) References Cited

U.S. PATENT DOCUMENTS

| | | | | |
|---|---|---|---|---|
| 243,406 | A | 6/1881 | Sample et al. | |
| 480,470 | A | 8/1892 | Maier | |
| 4,984,787 | A | 1/1991 | Nesbit et al. | |
| 5,124,899 | A * | 6/1992 | Hale | A63B 63/083 362/253 |
| 5,156,395 | A * | 10/1992 | Smith | A63B 63/083 248/188.4 |
| 5,305,998 | A | 4/1994 | Nesbit et al. | |
| 5,346,207 | A | 9/1994 | Heinen | |
| 5,388,821 | A | 2/1995 | Blackburn | |
| 5,547,185 | A | 8/1996 | Wagner et al. | |
| 5,677,896 | A | 10/1997 | Nunes | |
| 5,711,727 | A | 1/1998 | Edge et al. | |
| 6,302,811 | B1 | 10/2001 | Topham | |
| 6,367,948 | B2 | 4/2002 | Branson | |
| 6,626,773 | B1 | 9/2003 | Fair | |
| 7,244,046 | B2 | 7/2007 | Webb | |
| 7,393,293 | B2 | 7/2008 | Guerzini et al. | |
| 8,845,151 | B1 | 9/2014 | Hale | |

(Continued)

OTHER PUBLICATIONS

Google search: "led basketball hoop" search prior to Jan. 24, 2017.*

(Continued)

*Primary Examiner* — Diane I Lee
*Assistant Examiner* — Omar Rojas Cadima
(74) *Attorney, Agent, or Firm* — Woodard, Emhardt, Henry, Reeves & Wagner, LLP; Charles Meyer

(57) ABSTRACT

Certain preferred embodiments of the present invention provide an improved light raising and lowering apparatus and method for a basketball goal. A light assembly is mounted at the upper end of an arcuate pole. The pole extends through two pairs of rollers. The pole can be rolled upward and downward to raise and lower the light assembly.

20 Claims, 6 Drawing Sheets

(56) References Cited

U.S. PATENT DOCUMENTS

| | | | |
|---|---|---|---|
| 2001/0040803 | A1 | 11/2001 | Branson |
| 2002/0094890 | A1 | 7/2002 | White et al. |
| 2003/0137847 | A1 | 7/2003 | Cooper |
| 2007/0297165 | A1 | 12/2007 | Watson et al. |
| 2015/0247603 | A1 | 9/2015 | Caswell |

OTHER PUBLICATIONS

Amazon product page, Goarilla GS54, pole and Goalrilla LED hoop light.*
Australian Examination Report issued in Application No. 201714225, dated Oct. 23, 2017, 4 pgs.
Lifetime Owner's Manual With Assembly Instructions, Light Accessory Kit, Instruction No. 1026081 B, Published Mar. 20, 2012.

* cited by examiner

BASKETBALL LIGHT RAISING AND LOWERING APPARATUS AND METHOD

FIELD OF THE DISCLOSURE

The present disclosure relates generally to lighting for basketball goals and courts that assists game play in low natural light conditions, and more particularly to an apparatus and method for mounting, raising and lowering a lighting apparatus in relation to a basketball goal.

BACKGROUND

Various apparatuses and methods for providing light for basketball goals and courts are known. It is known to attach lights to basketball goals and their support structures to provide light in low or less-than-optimal lighting conditions. Some systems are adapted for use with an adjustable basketball goal where the height of the goal may be raised or lowered. Many systems are difficult to use and do not allow easy accessibility to the lamp for maintenance or for adjusting the lighting angle. Other systems can require strenuous exertion by one or more people to install and/or erect. Still other systems place the lamp behind or above the backboard potentially interfering with vision. Such systems typically require a ladder or disassembly of the basketball goal to access the light for mounting or to change a bulb. An improved apparatus and method for raising and lowering a light for a basketball goal is desired. Certain features of the present invention address these and other needs and provide other advantages.

SUMMARY

The present arrangement enables simplified raising and lowering of light arrangements for basketball goals, for example to replace light panels or bulbs, during inclement weather, or for aesthetics. The disclosure deals with an apparatus with a light assembly which can be mounted over a basketball goal. This assists people to play basketball in low-light conditions. In the illustrated arrangement, a light assembly is mounted at the upper end of an arcuate pole. The pole extends upward through two pairs of rollers arranged on mounting brackets extending from a base. The pole can be rolled upward and downward to raise and lower the light assembly. The apparatus may incorporate a lock mechanism. The lock mechanism may include one or both of a continuous resistance feature as a safety lock and discrete hard-lock locations.

The apparatus can be sold with a basketball assembly and installed by a professional during installation of a basketball goal. Alternately, the apparatus can be sold as a separate accessory or kit which can be added to a basketball goal by a professional installer or a consumer.

An example embodiment comprises a basketball goal with a vertical support member and a backboard with a front face where the vertical support member is configured to be vertically oriented during use. A pair of upper rollers is mounted to the vertical support member, and a pair of lower roller is also mounted to the vertical support member. A pole extends between the upper rollers and between the lower rollers; the upper and lower rollers allow the pole to roll upward and downward. A light assembly is mounted to an upper end of the pole.

In certain embodiments, the light assembly is a kit mountable on a basketball goal having a vertical support member and a backboard with a front face. The kit includes a first pair of rollers mountable to the vertical support member and a second pair of roller mountable to the vertical support member. The first pair of rollers and the second pair of rollers are aligned to define a path for a pole to extend through them and over the backboard. A pole is mountable in the path to extend between the first pair of rollers and to extend between the second pair of rollers. The pairs of rollers allow the pole to roll upward and downward along the path. A light assembly is mounted to an upper end of said pole. A locking mechanism may be incorporated in the kit. The kit may include a base plate and brackets.

A representative method is disclosed for mounting a light assembly on a basketball goal having a vertical support member and a backboard with a front face. The method includes mounting a pair of upper rollers on the vertical support member and mounting a pair of lower rollers on the vertical support member in a selected alignment with the pair of upper rollers. The method includes arranging a pole with a light assembly between the upper rollers and between the lower rollers, and rolling the pole upward between said rollers to raise the light assembly. In certain embodiments rolling the pole upward raises the light assembly vertically and moves the light assembly forward.

Further objects, features and advantages of the present disclosure shall become apparent from the detailed drawings and descriptions provided herein. Each embodiment described herein is not intended to address every object described herein, and each embodiment does not include each feature described. Some or all of these features may be present in the corresponding independent or dependent claims, but should not be construed to be a limitation unless expressly recited in a particular claim.

DETAILED DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles of the disclosure being contemplated as would normally occur to one skilled in the art to which the invention relates.

Certain preferred embodiments of the present disclosure provide an improved apparatus and method for mounting and selectively raising and lowering a lighting apparatus for a basketball goal. In brief, the disclosure deals with a light assembly which can be mounted over a basketball goal, typically outdoors. This assists people to play basketball in low-light conditions such as after dark. In the present arrangement, two LED light panels are mounted at the upper end of a segmented arcuate pole. A power cord (not shown) may extend through the pole. The pole extends upward through two pairs of rollers arranged on mounting brackets extending from a base. The base is mounted adjacent the upper end of a basketball goal support post. The upper pair of rollers may include a larger brace roller and a smaller guide roller.

The lower pair of rollers incorporates a lock mechanism. The lock mechanism may include one or both of a continuous resistance feature as a safety lock and discrete hard-lock locations.

This arrangement is a significant improvement in simplicity and ease of use compared to prior light arrangements. The arrangement enables simplified raising and lowering of the apparatus, for example to replace light panels or bulbs, during inclement weather, or for aesthetics. The apparatus can be sold with a basketball assembly already installed or installed by a professional during installation of a basketball goal. Alternately, the apparatus can be sold as a separate accessory or kit which can be added on to a basketball goal, for example by an installer or a consumer.

Figure 1:
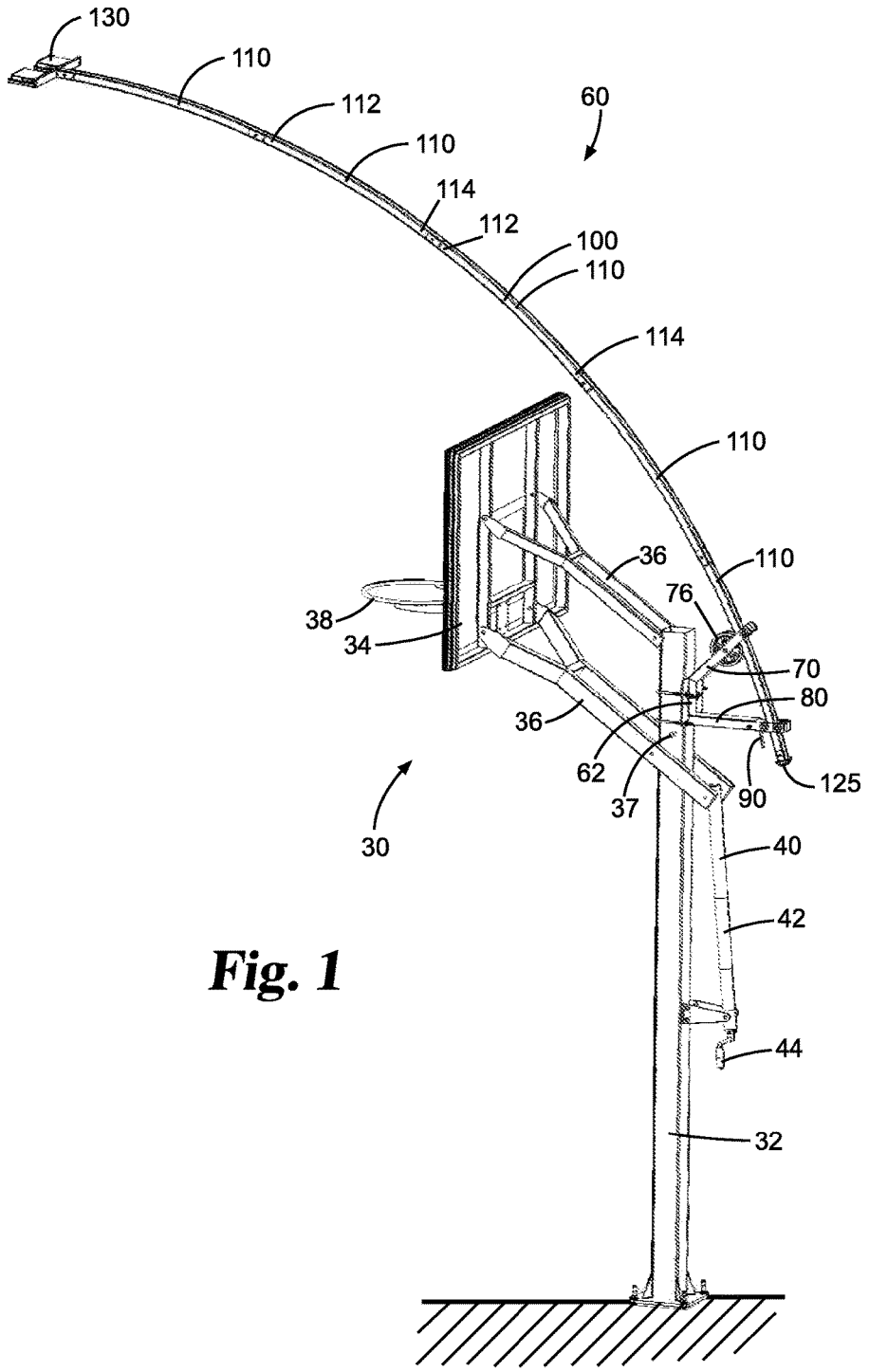
FIG. 1 is a perspective view of one embodiment with the lighting apparatus in the raised position.
Figure 2:
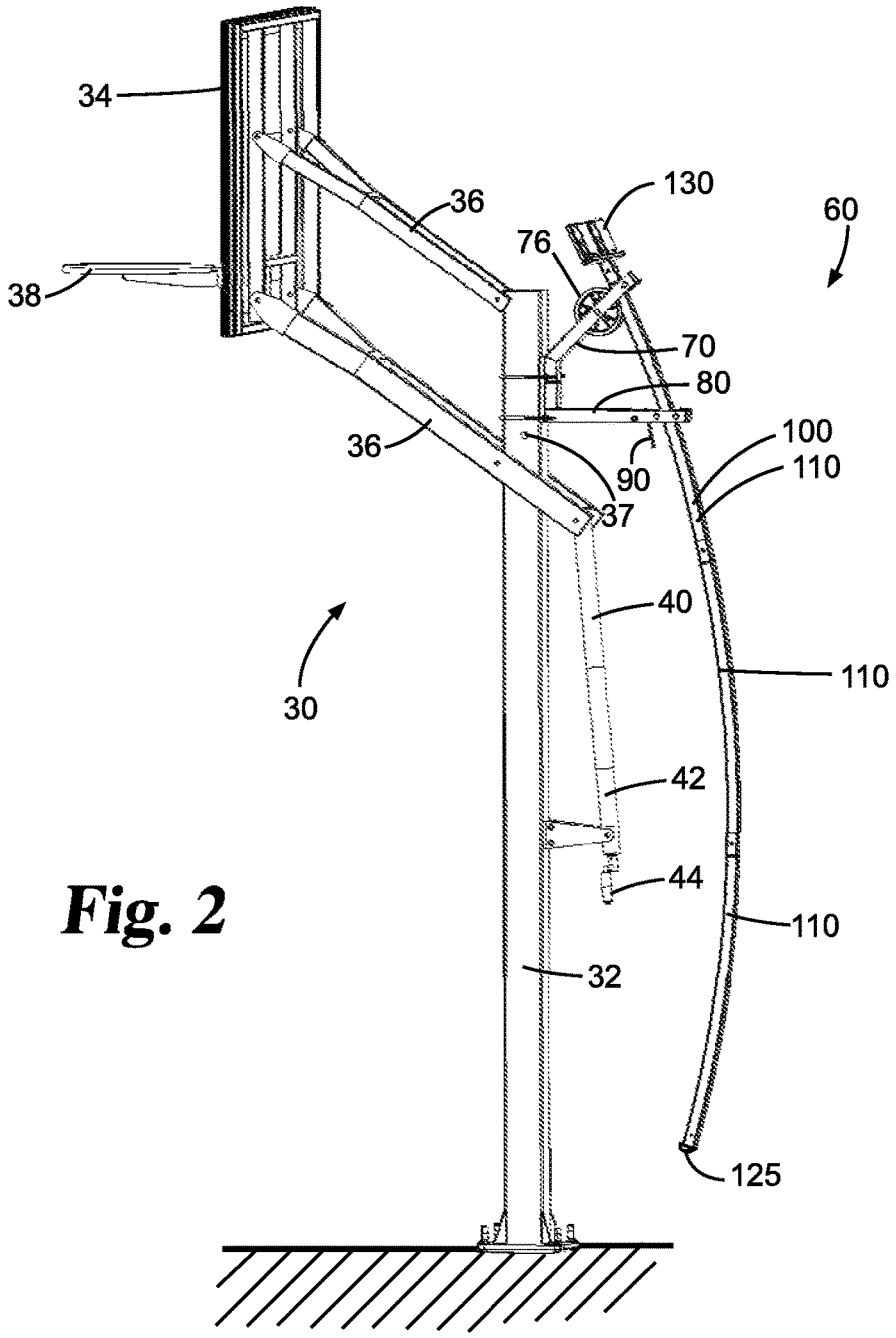
FIG. 2 is a perspective view of the embodiment of FIG. 1 with the lighting apparatus in the lowered position.

Illustrated in FIGS. 1 and 2 is a representative example of a conventional basketball goal 30. The illustrated example is not intended to be limiting. Lighting apparatus 60 is illustrated on goal 30 in the raised position in FIG. 1 and in the lowered position in FIG. 2. Basketball goal 30 includes a vertical support member, for example post 32 which is typically either a round or square post. The post is vertically oriented at approximately 90 degrees to the support surface or alternately may be angled and supports a backboard above a playing surface. Basketball goal also includes a backboard 34, support members 36, stop 37, and a hoop 38. Hoop 38 is attached on a forward side of backboard 34 near the lower edge. An optional net may be attached to hoop 38. The goal 30 may be fixed in place, for example by being anchored to the ground or by being mounted to an anchor in or on the ground. In alternate embodiments, the goal may be portable, with appropriate weight and load distribution and balancing.

Post 32, backboard 34 and pairs of adjustable support members 36 form an adjustable parallelogram arrangement when viewed from the side. Backboard 34 is supported by the parallelogram structure which is deformable to raise and lower backboard 34 in relation to post 32, while retaining a parallelogram shape. The parallelogram arrangement enables backboard 34 to be raised and lowered while maintaining it as vertical relative to the playing surface, typically parallel to support post 32 or a vertical axis through mounting points on post 32. In the depicted embodiment, the lower adjustable support members 36 include rear extension portions or lever arms which can be used to control the rotation of the parallelogram structure. Stop 37 is preferably provided as a safety device to limit the downward travel of backboard 34.

In the illustrated example, adjustment mechanism 40 is an expansion and retraction cylinder, for example compression cylinder 42 and crank handle 44. Adjustment mechanism 40 is pivotally attached to the rear portion of post 32 and to the rear extension portion of one or both lower support members 36. Crank handle 44 may be detachable. In alternate embodiments lighting apparatus 60 is usable with basketball goals that include other mechanisms for adjusting the backboard height and/or with non-adjustable basketball goals.

Referring to FIGS. 1 and 2, lighting apparatus 60 includes a pole, a light assembly and a mounting assembly. Pole 100 has an upper lamp end and a lower base end. A light assembly 130 is mounted to and supported by the upper lamp end of pole 100. The mounting assembly includes a base and a pair of brackets. In the illustrated embodiment, pole 100 is curved or arcuate and extends upward through two pairs of rollers in the mounting assembly. Pole 100 can be raised and lowered through the mounting assembly to raise and lower light assembly 130 by rolling it relative to basketball goal 30. In the illustrated embodiment, the curved profile of pole 100 and the angled alignment of the two pairs of rollers functions to move lamp assembly 130 both vertically and laterally as pole 100 is raised and lowered.

The pole 100 can be extended with the desired number of segments 110 added and rolled upward until the light reaches a desired height and location, for example at a height of seventeen feet. In some embodiments, segments can be added in stages during the process of rolling the pole upward. This can be done from the ground at some points, and for example using a six foot extension ladder to raise and lock the final segment.

With lighting apparatus 60 in a raised position, light assembly 130 is located on the same front side of backboard 34 as hoop 38. This location is advantageous for directly illuminating the backboard 34 and hoop 38 from the same side of backboard 34 as the players are typically located during play. This location also places light assembly 130 in a position where the players do not look directly at the light assembly 130 when shooting from a variety of locations. If backboard 34 is opaque, locating light assembly 130 on the front side of backboard 34 is especially important to avoid backboard 34 casting a shadow on hoop 38. In alternate embodiments, light assembly 130 may be located either directly above or behind backboard 34.

The overall length and geometry of pole 100 generally places light assembly 130 at a satisfactorily height and distance from backboard 34 to avoid pole 100 and light assembly 130 interfering with game play while providing illumination to backboard 34 and goal 38. Different embodiments may utilize different overall lengths and geometries to accommodate various game conditions.

Figure 3:
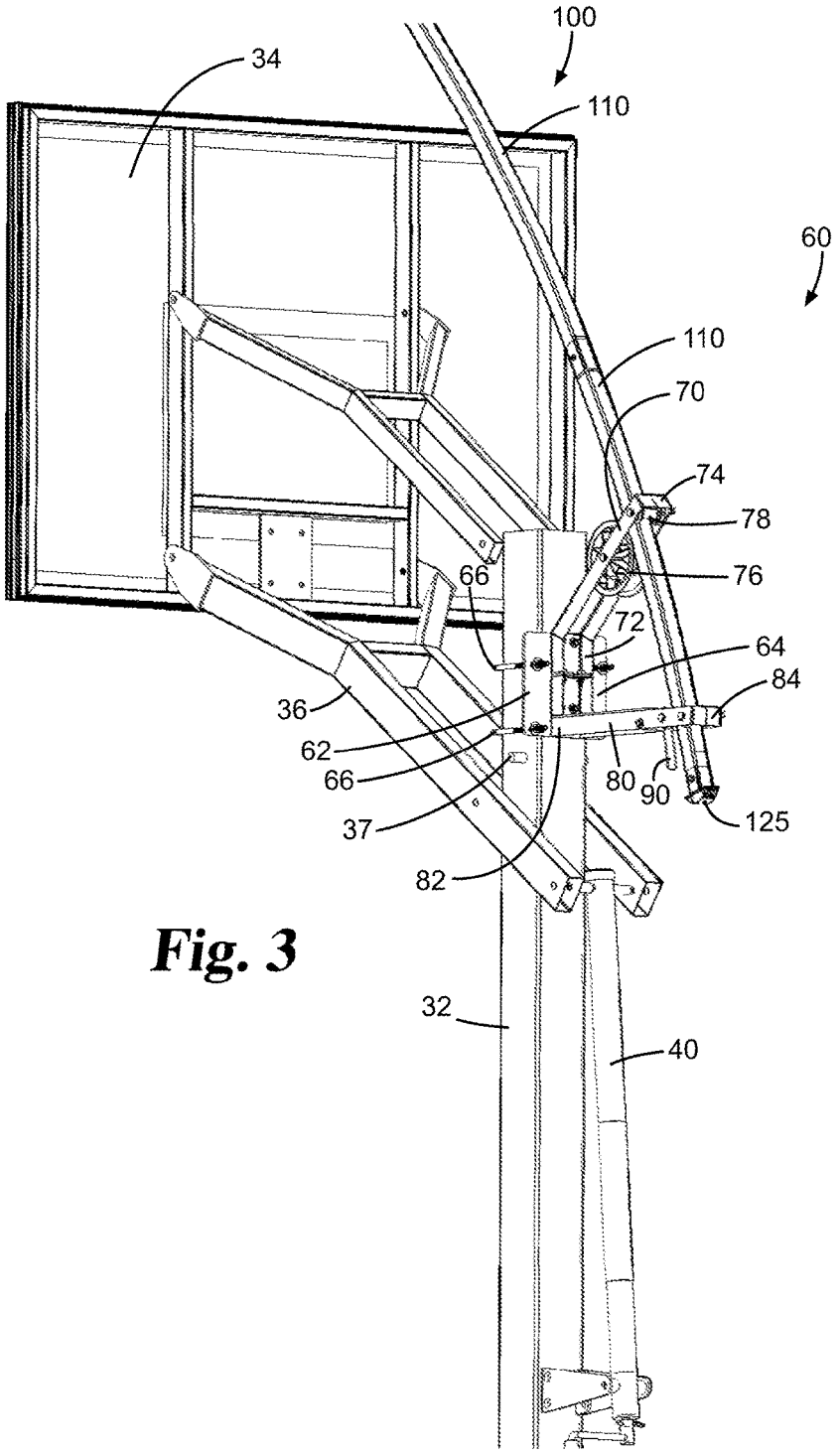
FIG. 3 is a rear perspective view of portions of the apparatus of FIG. 1.
Figure 4:
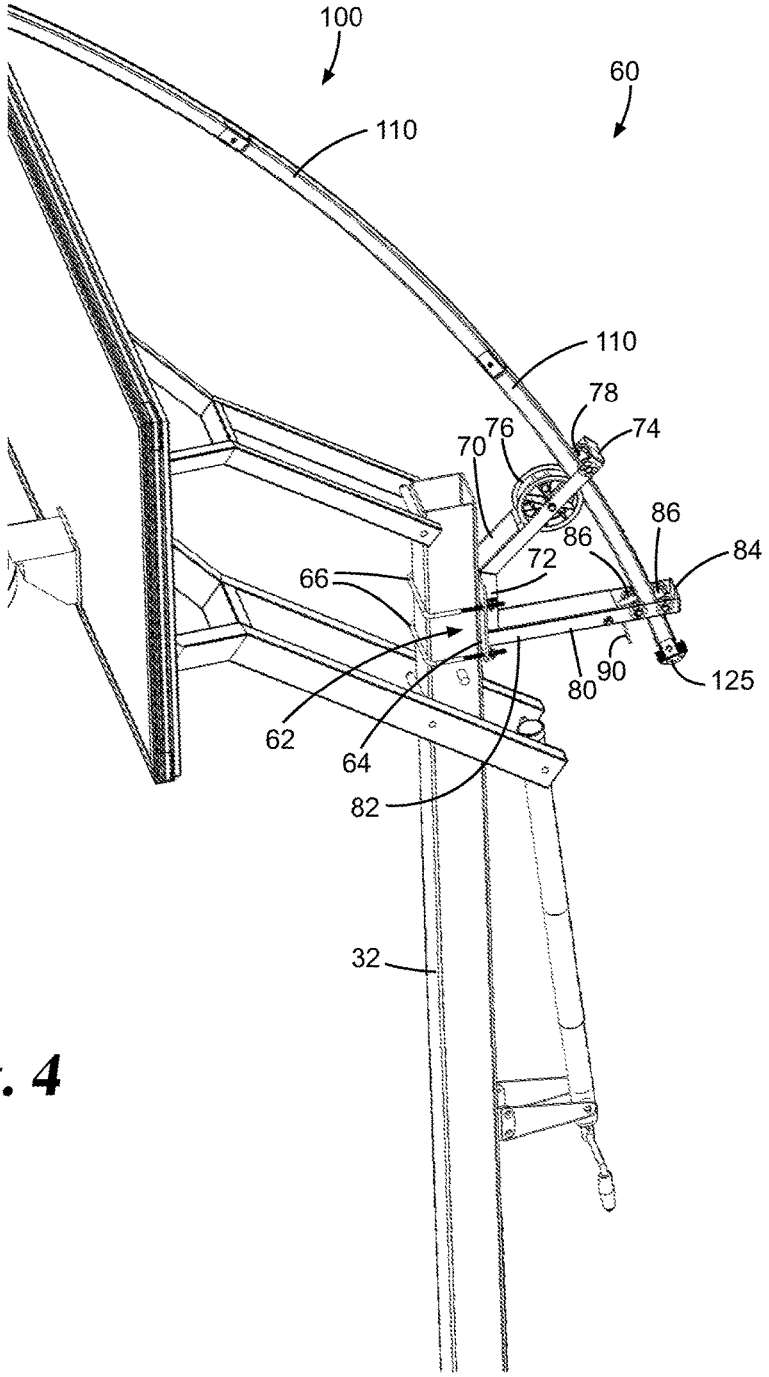
FIG. 4 is a downward perspective view of portions of the apparatus of FIG. 1.
Figure 5:
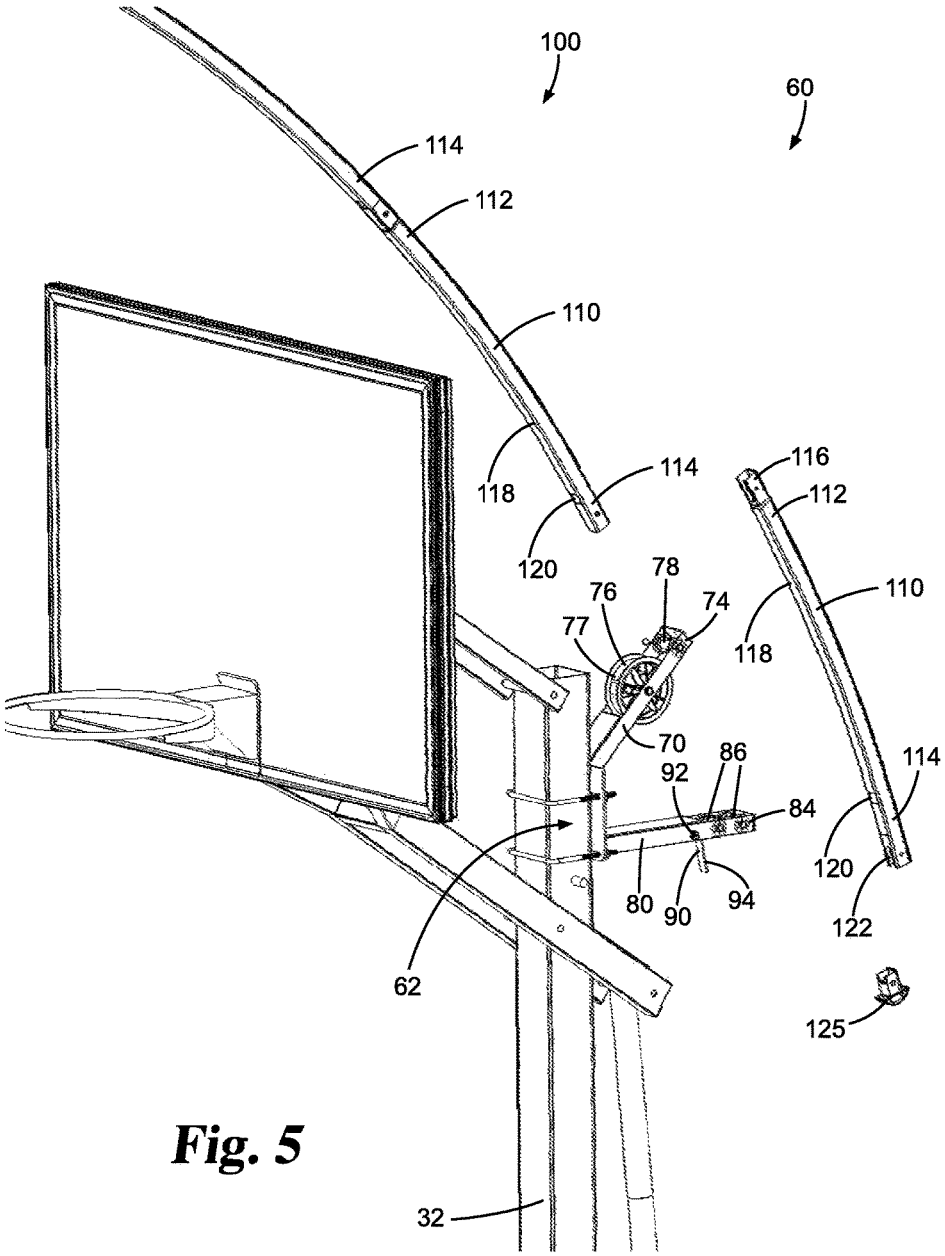
FIG. 5 is a partially exploded view of portions of the apparatus of FIG. 1.

Illustrated in closer views in FIGS. 3-5, the pole mounting assembly includes base assembly 62. Base assembly 62 can be mounted adjacent an upper end of post 32, typically on the rear side of post 32. Base assembly can be secured to post 32 using a clamping action or by other methods of securing it in place such as welding or bolts. In the illustrated embodiment, base assembly 62 includes a base plate 64 arranged parallel and adjacent to a rear face of post 32. A pair of threaded U-bolts 66 encircle post 32, with the ends of U-bolts 66 extending through plate 64. The U-bolt ends are threaded and secured by nuts which can be tightened to clamp base assembly around post 32. Preferably base assembly 62 is sufficiently secured to prevent vertical or rotational movement of base assembly 62 relative to post 32. In the illustrated embodiment the square cross-section of post 32 prevents base assembly 62 from rotating around post 32. In an embodiment with a round pole optionally a bracket piece or other portions can be used to help prevent rotation.

The mounting assembly further includes upper bracket 70 and lower bracket 80 extending rearward from base assembly 62. In alternate embodiments, the brackets can be secured directly to the post. In the illustrated version, upper bracket 70 is angled rearward and upward, while lower bracket 80 extends substantially horizontally rearward. Upper bracket 70 includes an inward end 72 secured to base plate 64 and an outer end 74. Similarly, lower bracket 80 includes an inward end 82 secured to base plate 64 and an outer end 84. Inward ends 72 and 82 can be permanently secured to base plate 62 as an integral piece or by welding. Alternately, inwards ends 72 may be secured using fasteners such as bolts and nuts. In certain embodiments, the bolt heads are arranged between the base plate 64 and post 32 and correspondingly bolts with low profile head are used. Alternately, base plate 64 or pole may define a nest or cavity to partially receive and provide clearance for the bolt heads. In certain embodiments, the compression force between base plate 64 and post 32 applies a clamping force to the bolt heads to help seat them in place against plate 64 and to provide torque resistance as the bolts are tightened.

A pair of rollers are pivotally mounted adjacent the outer end 74 of the upper bracket 70. In more details, the upper bracket rollers include a brace roller 76 and a guide roller 78. Brace roller 76 is arranged inward of guide roller 78 and is illustrated with a larger radius than guide roller 78. In the illustrated embodiment, brace roller 76 is larger to serve as a fulcrum to both guide and support pole 100 as the pole is raised and lowered. Each roller defines a groove, for example brace roller defines groove 77. Rollers 76 and 78 and specifically the respective groove depths are spaced apart a distance sized to receive, engage, contain and guide the thickness and width of pole 100 between the rollers and to allow rolling movement of pole 100 through the rollers.

A separate pair of rollers 86 are pivotally mounted adjacent the outer end 84 of the lower bracket 80. Each roller 86 also defines a groove. Rollers 86 and specifically the groove depths are spaced apart a distance sized to receive, engage, contain and guide the thickness and width of pole 100 to allow pole 100 to roll between the rollers.

Upper rollers 76 and 78 are aligned relative to lower rollers 86 to define a pathway for pole 100 to extend through both sets of rollers and are configured to enable the pole to roll through both sets of rollers simultaneously. In the illustrated embodiment, upper rollers 76 and 78 are spaced upward and closer to post 32 than lower rollers 86. Preferably the pathway for pole 100 through the rollers continues upward and forward from the rollers and over backboard 34. Preferably, if an adjustable backboard is present, the pathway is arranged to not intersect the backboard within the backboard's range of movement.

Figure 6:
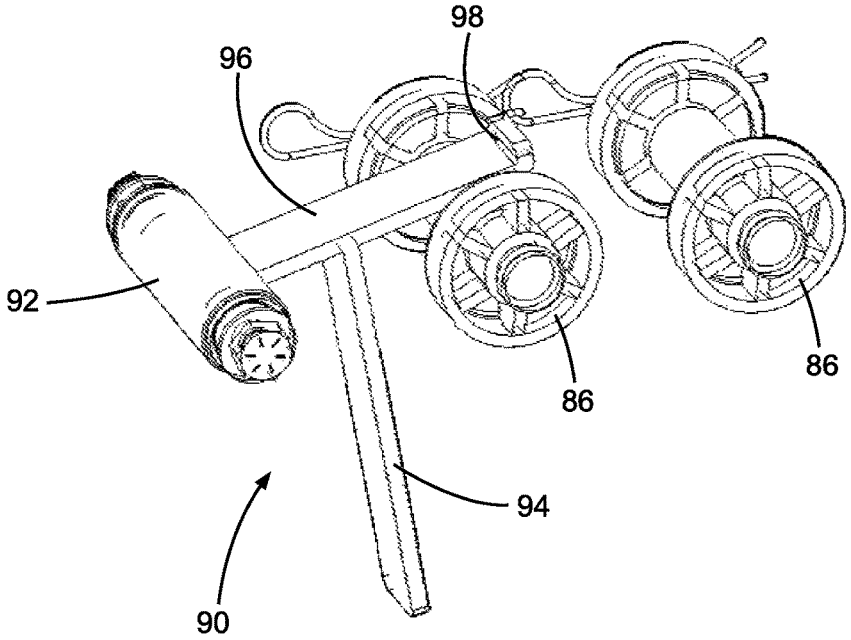
FIG. 6 is a partial view of the rollers and locking lever arranged in the lower mounting bracket of the apparatus of FIG. 1.

A locking lever 90 is arranged in lower bracket 80 adjacent to rollers 86. Locking lever 90 and rollers 86 are illustrated in a detailed view in FIG. 6. Lower bracket 80 is omitted in FIG. 6 to better illustrate the arrangement of locking lever 90 relative to rollers 86. Locking lever 90 is arranged slightly inward and closer to post 32 than the inward roller 86. Locking lever 90 includes a pivot portion 92. Pivot portion 92 is pivotally mounted to lower bracket 80, for example with a bolt, and defines a pivot axis. A locking beam portion 96 extends outward from pivot portion 92 with an outer end 98 arranged over the groove portion and axle of inward roller 86. The length of locking beam portion 96 is sized so that outer end 98 may contact pole 100 and at some points extend into pole 100. A handle portion 94 extends downward from beam portion 96 and is accessible from the exterior of lower bracket 80, for example by someone on a ladder. Handle portion 94 can be used to manually raise and lower locking lever 90 to pivot around the pivot axis.

The outer end 98 of beam portion 96 may optionally have a hook portion. Optionally, outer end 98 may have a frictional texture for example with a rubber coating or cover. Lever 90 may be biased so that outer end 98 pivots toward roller 86. The biasing may be due to gravity or alternately a spring or elastic component may apply a bias.

Pole 100 is arranged to extend through the mounting assembly and specifically between the rollers in upper bracket 70 and the rollers in lower bracket 80. In some embodiments, pole 100 may be formed in one continuous piece. As illustrated in a partially exploded view in FIG. 5, in some embodiments pole 100 is formed from a series of discrete pole segments 110. Each pole segment 110 includes an upper end 112 and a lower end 114. Pole segments 110 can be assembled to connect to each other in series. The number of segments used can be selected or varied to achieve a total desired pole length. In the illustrated embodiment, each pole segment 110 includes a swaged portion 116 which can be fittingly received in an opening defined in the end 114 of an adjacent pole segment. A fastener such as a bolt, screw, cotter pin or rivet can be placed through aligned holes in the swaged portion 116 and a receiving end 114 of an adjacent pole segment to lock the pole segments 110 together. The square cross-section of the illustrated pole segment and swaged portion prevents relative twisting between pole segments. In other embodiments, other pole segment connection arrangements, cross-sections and twist-resistant mechanism can be used. Examples include other nesting arrangements, segment-to-segment connector pieces, overlapping plates, internal connector pieces, and connections with or without fasteners.

The upper end of assembled pole 100 connects to and supports light assembly 130. The lower base end of pole 100 can be closed or covered with a plug or cap 125. Assembled pole 100 is preferably hollow to allow a power cord for light assembly 130 to be fed through the pole from the light assembly and to exit the base end of pole 100. Slots or openings 122 may be defined in the pole sections 110 to provide entry and exit openings for the power cord.

During assembly an initial pole segment 110 with light assembly 130 is arranged through both roller pairs. The pole 100 can be extended with the desired number of segments 110 added and rolled upward until the light assembly 130 reaches a desired height and location. The angled relationship of the upper and lower roller pairs and the curved geometry of pole 100 cause the light assembly 130 to be moved both upward and laterally in front of backboard 34 when being raised, and correspondingly rearward and lower as pole 100 is lowered. The overall lighting apparatus 60 is preferably sized and weighted so that pole 100 and light assembly 130 can be safely raised and lowered manually with a minimum of force. In alternate embodiments, an assistive raising or lowering force can be supplied, for example using a cable and pulleys or a manual or powered winch.

In some embodiments, segments 110 can be added in stages during the process of rolling the pole 100 upward. This can be done from the ground at some points, and using a ladder to raise and lock the final segment. This arrangement is a significant improvement in simplicity and ease of use compared to prior light arrangements. The arrangement also enables simplified lowering of the assembly, for example to replace light panels or bulbs, during inclement weather, or for aesthetics.

In one aspect, the lower pair of rollers 86 and lever lock 90 interact with pole 100 to provide one or both of discrete hard lock positions as well as continuous safety lock positions. The outer end 98 of lever lock 90 is configured to contact and bear against pole 100 during raising and lowering of pole 100. As pole 100 is rolled upward through lower rollers 86, locking lever 90 rotates upward and moves out of the way or slides along the inward face 118 of pole 100, not providing resistance. In contrast, as the pole 100 is rolled downward, the lever lock 90 pivots downward and against the inward roller 86. Outer end 98 is then braced against the inward roller 86 and consequently the lock beam end 98 is pressed against inward face 118 of pole 100. The pushing force applied via lock beam 96 creates a wedging action pushing pole 100 outward toward outward roller 86 and creates continuous frictional resistance. This resistance functions as a safety lock and holds pole 100 in place. The lock can be disengaged by the user lifting the lever lock 90, which may require a slight lifting of pole 100. In some embodiments, the resistance can be overcome by a user pulling pole 100 downward to overcome the resistance.

Periodically along the length of pole 100, the inward face 118 of pole 100 and the pole segments 110 define openings or slots 120. As the pole 100 is lowered through lower rollers 86 lock beam end 98 will be slightly pivoted upward from inward roller 86 to disengage from and/or slide along inward face 118 of pole 100. When the lock beam end 98 encounters an opening 120, the beam end 98 enters the opening 120 and the hooked end engages opening 120, lock lever then bears against inward roller 86 and holds the pole 100. This provides discrete defined hard lock positions on pole 100. The lock lever must be manually disengaged from each hard lock position by slightly lifting the pole 100 and by manually using the handle 94 to rotate the lever lock 90 out of the opening. The lever lock 90 is then manually held away from the opening, allowing the pole 100 to be lowered so that the opening 120 is past the lever lock 90. The lever lock 90 must be continuously or repeatedly held open if pole 100 is rolled past multiple hard lock positions.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected. Dimensions are not intended to be limiting and may be altered as would be understood by one of ordinary skill in the art.

What is claimed is:

1. A basketball goal and light assembly apparatus, comprising:

a basketball goal with a vertical support member and a backboard with a front face;

a pair of upper rollers mounted to said vertical support member;

a pair of lower roller mounted to said vertical support member;

an arcuate pole curved along the majority of the length of the pole with a curved portion extending between said upper rollers and extending between said lower rollers; said upper and lower rollers allowing said pole to roll upward and downward along an arcuate path; and, a light assembly mounted to an upper end of said pole.

2. The apparatus of claim 1, wherein said pole raises said light assembly vertically and moves said light assembly forward relative to said backboard front face when said pole is raised.

3. The apparatus of claim 1, wherein said pole is assembled from a series of discrete pole segments.

4. The apparatus of claim 1, comprising a locking mechanism providing a continuous resistance force during downward rolling movement of said pole.

5. The apparatus of claim 4, comprising a locking lever pivotally arranged with a locking beam having a beam end portion extending over a groove portion and axle of an inward one of said lower rollers and wherein said beam end portion of said locking lever bears against an inward face of said pole with a wedging force to provide said continuous resistive force.

6. The apparatus of claim 1, comprising a locking mechanism providing a hard lock engagement at discrete points along the length of said pole.

7. The apparatus of claim 6, comprising a locking lever adjacent said lower rollers and wherein said pole defines into a hollow interior of said pole at said discrete points and wherein a beam end portion of said locking lever enters the hollow interior of said pole and retains one of said pole openings to provide said hard lock engagement.

8. The apparatus of claim 6, wherein said locking mechanism must be manually disengaged from said hard lock engagement points.

9. The apparatus of claim 1, wherein said upper rollers are spaced upward and closer to said post than said lower rollers.

10. A light assembly kit mountable on a basketball goal having a vertical support member and a backboard with a front face, comprising:

a first pair of rollers mountable to the vertical support member;

a second pair of rollers mountable to the vertical support member wherein said first pair of rollers and said second pair of rollers are aligned to define a non-vertical path for a pole to extend through them and over the backboard;

the pole mountable in the path to extend between said first pair of rollers and to extend between said second pair of rollers wherein one of said upper rollers is arranged beneath the pole and engages a downward facing inward face of the pole; said pairs of rollers allowing said pole to roll upward and downward along the path; and, a light assembly mounted to an upper end of said pole.

11. The kit of claim 10, wherein said pole is curved.

12. The kit of claim 11, wherein said pole is comprised with a series of discrete pole segments.

13. The kit of claim 10, comprising a base assembly mountable to the vertical support member, wherein the base assembly comprises a base plate mountable to the vertical support member, an upper bracket with said first pair of rollers and a lower bracket with said second pair of rollers.

14. The kit of claim 13, comprising a locking lever mounted adjacent at least one roller and operable as a locking mechanism to retain said pole from rolling downward.

15. The kit of claim 14, wherein said locking lever provides a continuous resistance force during downward rolling movement of said pole.

16. The kit of claim 14, wherein said locking lever provides a hard lock engagement at discrete points along the length of said pole.

17. A method of mounting a light assembly on a basketball goal having a vertical support member and a backboard with a front face, comprising:

mounting a pair of upper rollers on the vertical support member including a brace roller and a guide roller, wherein said brace roller is arranged downward and inward from said guide roller;

mounting a pair of lower rollers on said vertical support member in alignment along a pole path with said pair of upper rollers wherein said upper rollers are spaced upward from said lower rollers;

arranging a pole with a light assembly between said upper rollers and between said lower rollers;

rolling the pole upward between said upper rollers and said lower rollers to raise the light assembly.

18. The method of claim 17, comprising manually disengaging a locking mechanism when rolling said pole downward.

19. A method of mounting a light assembly on a basketball goal having a vertical support member and a backboard with a front face, comprising:

mounting a pair of upper rollers on the vertical support member;

mounting a pair of lower rollers on said vertical support member in alignment with said pair of upper rollers;

arranging a pole with a light assembly between said upper rollers and between said lower rollers;

rolling the pole upward between said upper rollers and said lower rollers to raise the light assembly wherein rolling the pole upward raises the light assembly vertically and moves the light assembly forward relative to the backboard.

20. The method of claim 17, comprising assembling the pole from a series of discrete pole segments.

* * * * *